US007232298B2

(12) United States Patent
Sundstrom

(10) Patent No.: US 7,232,298 B2
(45) Date of Patent: Jun. 19, 2007

(54) SCREW COMPRESSOR IN WHICH THE TRAILING FLANKS OF THE LOBES OF AT LEAST ONE ROTOR BODY ARE BEVELED AT AN END SURFACE OF THE ROTOR BODY NEAR THE OUTLET PORT

(75) Inventor: Mats Sundstrom, Ingaro (SE)

(73) Assignee: Svenska Rotor Maskiner AB, Stockholm (SE)

( * ) Notice: Subject to any disclaimer, the term of this patent is extended or adjusted under 35 U.S.C. 154(b) by 11 days.

(21) Appl. No.: 10/524,346

(22) PCT Filed: Jul. 11, 2003

(86) PCT No.: PCT/SE03/01203

§ 371 (c)(1),
(2), (4) Date: Aug. 19, 2005

(87) PCT Pub. No.: WO2004/016950

PCT Pub. Date: Feb. 26, 2004

(65) Prior Publication Data

US 2006/0088434 A1 Apr. 27, 2006

(30) Foreign Application Priority Data

Aug. 14, 2002 (SE) ..... 0202413

(51) Int. Cl.
*F03C 2/00* (2006.01)
*F04C 18/00* (2006.01)

(52) U.S. Cl. ..... 418/201.3; 418/152; 418/206.5

(58) Field of Classification Search ..... 418/152, 418/201.3, 206.5
See application file for complete search history.

(56) References Cited

U.S. PATENT DOCUMENTS 2,174,522 A * 10/1939 Lysholm ..... 418/201.3
2,457,314 A 12/1948 Lysholm
3,166,238 A 1/1965 White et al.
3,610,787 A 10/1971 Ivanovich et al.
3,640,649 A * 2/1972 Persson ..... 418/201.3

(Continued)

FOREIGN PATENT DOCUMENTS

JP 53039508 A * 4/1978

(Continued)

*Primary Examiner*—Theresa Trieu
(74) *Attorney, Agent, or Firm*—Frishauf, Holtz, Goodman & Chick, P.C.

(57) ABSTRACT

A helical screw rotor compressor is provided which includes a rotor housing that includes a barrel wall between two parallel end walls, an inlet port at a first end and an outlet port at a second end. The compressor has an internal shape corresponding to two parallel and mutually intersecting cylinders. The compressor includes two rotors which each include a shaft and a rotor body surrounding the shaft. The rotor bodies have parallel end surfaces adjacent to the end walls of the rotor housing, and each include helical lobes that have a crown, a first or leading flank surface on a first side of the crown and a second or trailing flank surface on a second side of the crown. The second or trailing flank surfaces of the lobes have a beveled or chamfered region adjacent to the end surface of the rotor body near the outlet port.

8 Claims, 3 Drawing Sheets

U.S. PATENT DOCUMENTS 4,761,124 A * 8/1988 Timuska et al. ..... 418/201.3
5,350,286 A 9/1994 Kisi et al.
5,947,713 A * 9/1999 Ohman et al. ..... 418/201.3

FOREIGN PATENT DOCUMENTS

JP 01208587 A * 8/1989 ..... 418/201.3
JP 02176190 A * 7/1990 ..... 418/201.3
WO WO 0128746 A1 4/2001
WO WO 0128747 A1 4/2001

* cited by examiner

SCREW COMPRESSOR IN WHICH THE TRAILING FLANKS OF THE LOBES OF AT LEAST ONE ROTOR BODY ARE BEVELED AT AN END SURFACE OF THE ROTOR BODY NEAR THE OUTLET PORT

This application is a U.S. National Phase Application under 35 USC 371 of International Application PCT/SE2003/001203 filed Jul. 11, 2003.

BACKGROUND OF THE INVENTION

The present invention relates to a helical screw rotor compressor that comprises a rotor housing which includes a barrel wall between two parallel end walls and further includes an input port at a first end and an outlet port at a second end and which has internally the form of two parallel, mutually intersecting cylinders. The compressor also comprises two rotors which co-act with one another and also with the rotor housing, said rotors including a rotor shaft which is mounted in the end walls, and a rotor body which surrounds the shaft in said rotor housing with parallel end surfaces adjacent the end walls of the rotor housing. The rotor bodies include mutual discrete helical lobes which each have a crown, a first or leading side surface on a first side of the crown and a second or trailing side surface on a second side of the crown.

Such compressors are well known to the person skilled in this art.

In recent times, rotors for screw compressors have increasingly been produced from a metal shaft around which there has been anchored a polymeric body that includes helical lobes separated by intermediate grooves. Such rotors are described in WO 01/28746 and in WO 01/28747 for instance. These polymer bodies have planar parallel end surfaces that face at right angles to the metal shaft. Because the lobes extend helically, a first side surface or flank surface of the lobe defines an acute angle at one end surface and a second side surface or flank surface of said helical lobe defines an obtuse angle with said end surface. The thickness of the lobe material is relatively small in the region in which the first side surface of the lobe defines an acute angle with said end surface, resulting in a comparatively weaker lobe. This is probably the reason why pieces of the lobes of the rotor body are torn loose when the rotors are used as active components in helical screw compressors. This applies in particular to that end of the rotor at which the highest pressure prevails, in other words at the outlet port of the compressor. Damage of this nature leads to a reduction in compressor efficiency. This may be due to a connection between an outlet space on the high pressure side of the compressor and its high pressure chamber being opened earlier than intended, therewith allowing gas to flow from the outlet space into the compressor chamber under certain conditions. Torn-off fragments, i.e. chips, slivers etc., also result in contamination of the gas system and in the worst case in significant damage to or even destruction of the compressor. Such damage occurs to a small extent, when the rotor is made of a metal that is much stronger and less brittle than polymeric material.

SUMMARY OF THE INVENTION

The object of the present invention is to provide a helical screw rotor compressor comprising polymeric rotor bodies that are more resistant to the forces to which they are subjected in operation, than was earlier the case.

This object is achieved in accordance with the invention by a helical screw rotor compressor in which the rotor body of at least one of the two rotors of said compressor is modified at said outlet end. This modification consists in bevelling or chamfering respective trailing flank surfaces of the rotor lobes at the end surface at which the outlet is situated.

BRIEF DESCRIPTION OF THE DRAWINGS

The invention will now be described in more detail with reference to the accompanying drawings in which.

DETAILED DESCRIPTION

Figure 1:
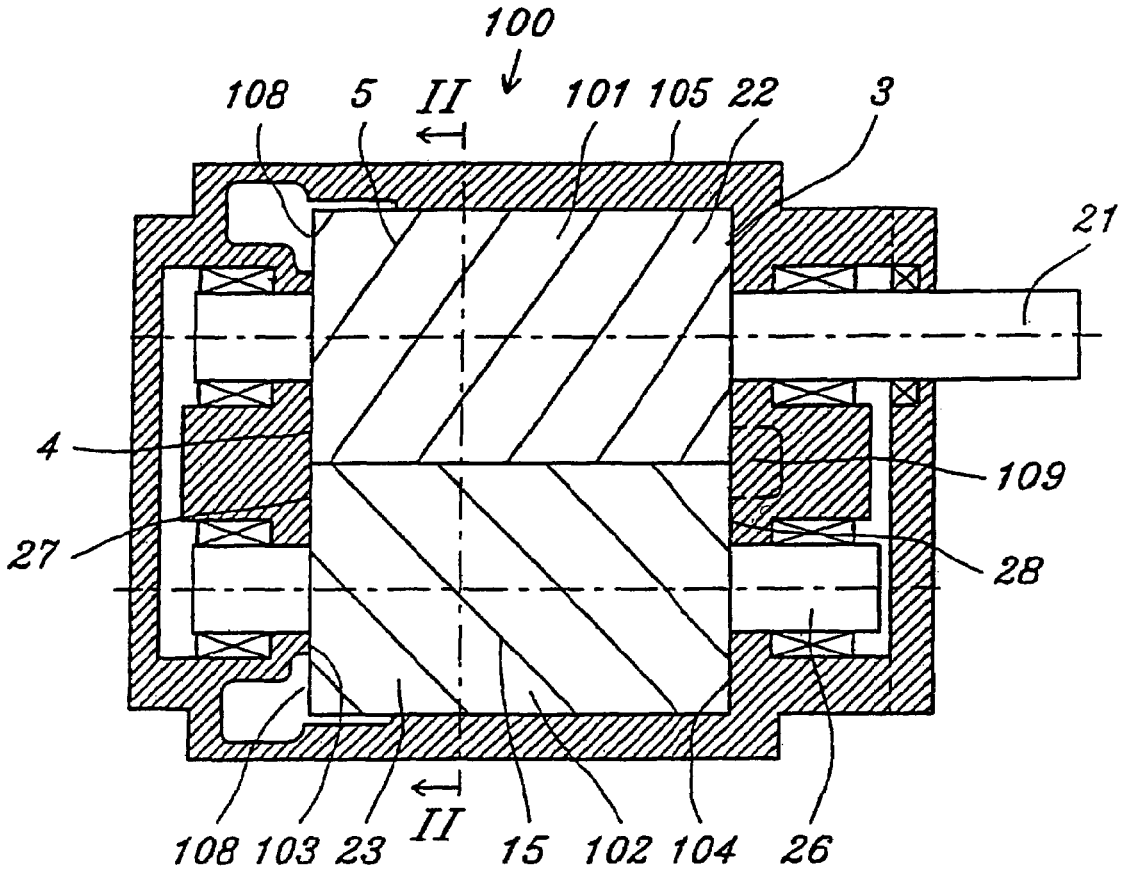
FIG. 1 is a schematic longitudinally sectioned view of a known helical screw compressor that includes two helical screw rotors.

The construction and working principle of a helical screw compressor is described briefly below, with reference to FIGS. 1 and 2.

A compressor 100 includes two mutually engaging screw rotors, of which a first rotor 101 is a male rotor and a second rotor is a female rotor 102. The rotors 101, 102 are rotatably mounted in a working chamber which is delimited by a first end wall 103, a second end wall 104 and a barrel wall 105 that extends between the end walls 103, 104. As will be seen from FIG. 2, the barrel wall has a form that corresponds generally to the form of two mutually intersecting cylinders. The compressor has an inlet port 108 at the first end wall 103 and an outlet port 109 at the second end wall 104.

The male rotor 101 has a rotor body 22 that includes a plurality of lobes 106 and intermediate lobes grooves 111 which extend in a helical line along the rotor 22. Similarly, the female rotor 102 has a rotor body 23 which includes a plurality of lobes 107 and intermediate grooves 112 that extend in a helical line along the rotor 23. The major part of each lobe 106 on the male rotor 101 is located outwardly of the circle of contact with the female rotor 102, whereas the major part of each lobe 107 on the female rotor 102 is located inwardly of said circle of contact. The female rotor 102 will normally have more lobes than the male rotor 101. A typical combination is one in which the male rotor 101 has four lobe and the female rotor 102 six lobes.

The gas to be compressed, normally air, is delivered to the working space of the compressor through an inlet port 108 and then compressed in V-shaped working chambers defined between the rotors and the chamber walls. Each chamber moves to the right in FIG. 1, as the rotors 101, 102 rotate. The volume of a working chamber decreases continuously during the latter part of its cycle, after communication with the inlet port 108 has been cut off. The gas is therewith compressed and leaves the compressor through an outlet port 109. The ratio of outlet pressure to inlet pressure is determined by the built-in volumetric relationship between the volume of a working chamber immediately after its communication with the inlet port has been cut-off and its volume when it commences communication with the outlet port 109.

Figure 2:
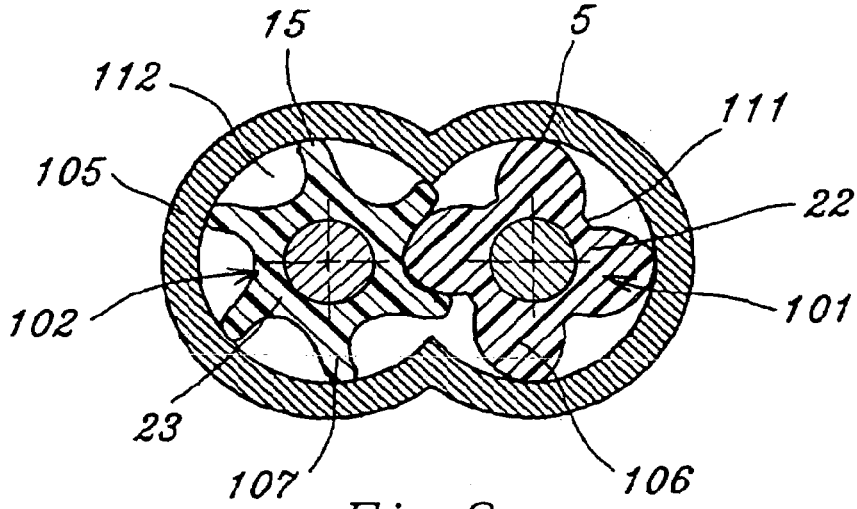
FIG. 2 is a sectional view taken on the line 11—11 in FIG. 1.

The male rotor in FIG. 1 has a shaft 21 around which the rotor body 22 is disposed. The rotor body 22 has a first end surface 4, which lies in the close proximity to the first end wall 103, and a second end surface 3, which lies in close proximity to the second end wall 104. The lobes 106 of the rotor body 22 have crowns 5, shown linearly in FIG. 1.

The female rotor 102 in FIG. 1 has a shaft 26 around which the rotor body 23 is disposed. The rotor body 23 includes a first end surface 27, which lies in close proximity to the first end wall 103, and a second end surface 28, which lies in close proximity to the second end wall 104. The lobes 107 of the rotor body 23 have crowns 15, shown linearly in FIG. 1.

Figure 3:
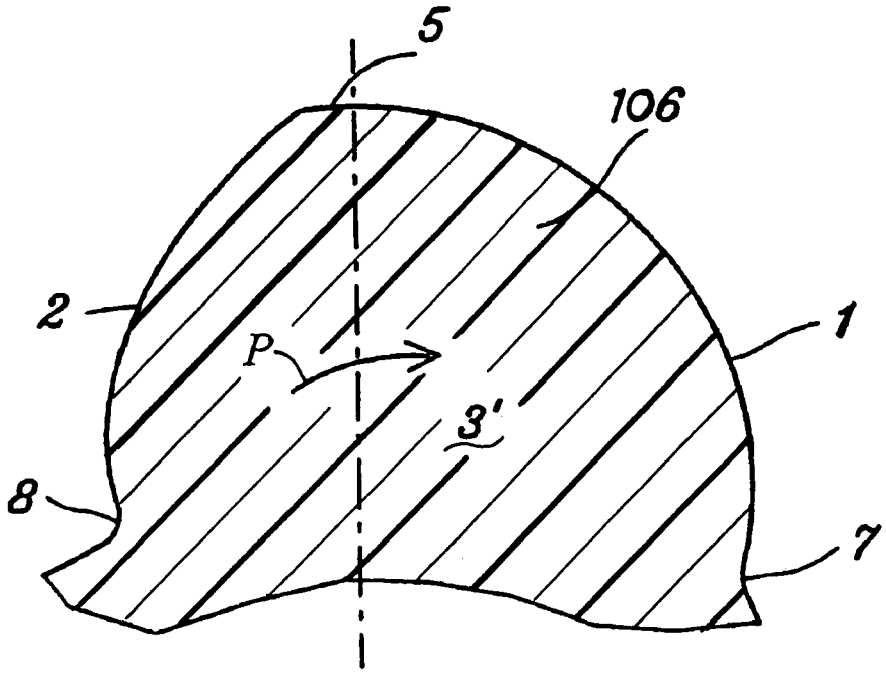
FIG. 3 is a sectional view on larger scale of a lobe on a male rotor as seen from the outlet end of the compressor, said view being taken at a distance from the end of the rotor.

FIG. 3 is a sectional view of a lobe 106 on the male rotor 101, taken at a right angle to the rotor shaft 21 in the middle portion of the rotor body and seen from the outlet end of the compressor. The sectional area is referenced 3'. The lobe 106 has a top or crown 5, a leading first flank surface or side surface 1, which extends from the crown 5 to a foot 7, and a following or trailing second flank surface or side surface 2, which extends from said crown 5 to a second foot 8. The lobe 106 moves in the direction of arrow P as the rotor rotates. Beyond the section 3' the lobe 106 extends helically along the rotor body 22. The leading first flank surface 1 therewith defines an obtuse angle with the section plane 3' and the trailing second flank surface 2 defines an acute angle with said plane 3'.

Figure 4:
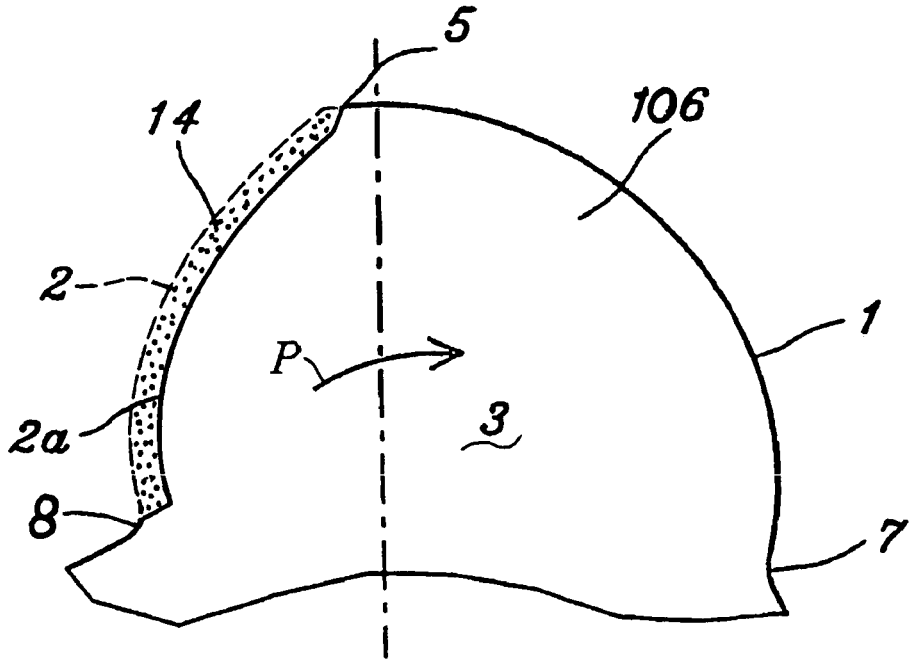
FIG. 4 illustrates the same rotor as that shown in FIG. 3 in the end plane of the male rotor, seen from the outlet end of the compressor.

FIG. 4 shows an end surface 3 at the compressor outlet end of the rotor lobe 106. This surface 3 lies in a plane parallel with the plane 3' in FIG. 3 and is viewed in the same direction as the section plane 3'. The lobes 106 of the rotor body 22 differ at the end plane with respect to the shape and extension of the trailing flank surface or side surface. The flank surface 2 shown with broken lines or dashes corresponds to the flank surface 2 (shown with a full line) in FIG. 3. The trailing flank surface of the lobe 106 in FIG. 4 is referenced 2*a*. The stippled area 14 of FIG. 4 shows the difference between the extensions of the trailing second flank surface in the end surface 3 in relation to a plane 3' in the rotor body 22 at a distance from the end plane. This stippled area 14 corresponds to the apex of the acute angle defined between the end surface 3 and the trailing second flank surface 2. The area 14 situated between the flank surface line 2*a* of the end surface 3 and the flank surface line 2 of the lobe 106 may be flat, rounded or have some other shape, or may be parallel with the rotor axis. The important fact is that the string of material located in the apex of the acute angle between the end surface 3 and the trailing second flank surface 2 of the lobe 106 in the case of known rotors is either removed or the rotor is produced in the absence of such a string.

Figure 5:
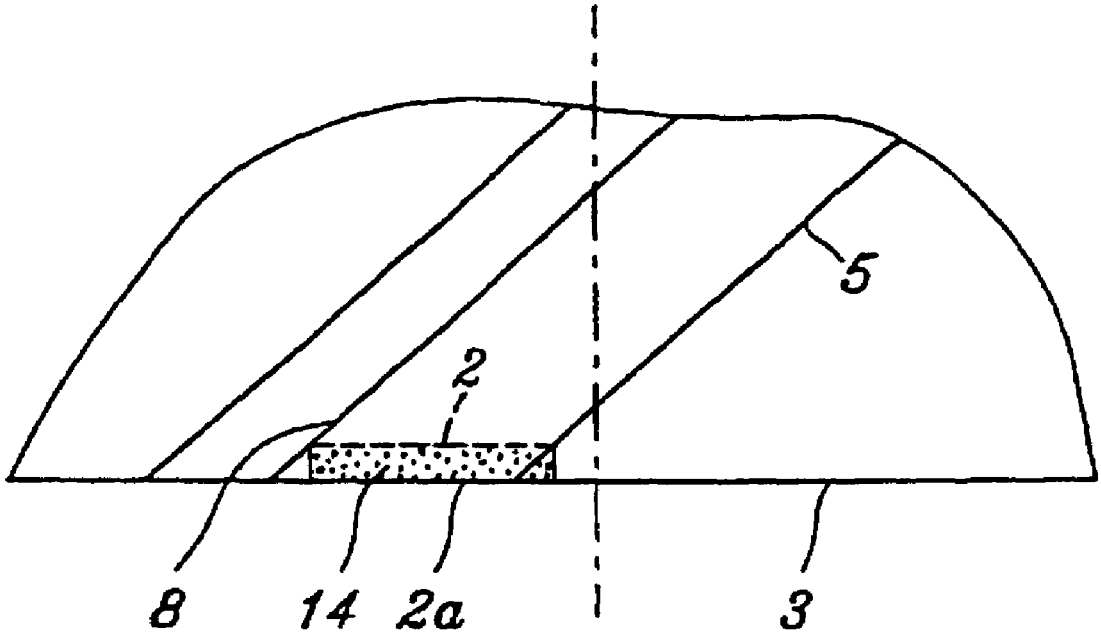
FIG. 5 is a schematic partial view of the male lobe shown in FIG. 3, as seen from above in the end of the rotor at the outlet end of the compressor.

FIG. 5 shows part of the rotor body from above. The crown of the lobe 106 is also referenced 5 in this figure. It will be seen from the figure that extension of the trailing second flank surface 2 begins at a distance from the end surface 3. It will also be seen that the "removed" or non-existing material string corresponds to an extension of the crown 5 of the lobe 106 to the foot 8 of said lobe 106.

The purpose of this modification of the rotor lobe is to ensure that no parts of small material thicknesses will be present at said end surfaces. For instance, the original pointed tip may be bevelled or chamfered or given a rounded shape or given a flat surface parallel with the rotor axis.

Although the present invention has been described solely with reference to the configuration of the male rotor 101, it will be understood that the female rotor 102 may be modified in the same way.

The invention claimed is:

1. A helical screw rotor compressor comprising:

a rotor housing that includes a first end wall and a second end wall, wherein said walls are parallel with one another and connected by a barrel wall, wherein said barrel wall has internally the shape of two parallel and mutually intersecting cylinders, and wherein the rotor housing further includes an inlet port at a first end and an outlet port at a second end, two rotors which co-act with each other and also with the rotor housing and each of which includes a respective shaft mounted in end walls of the compressor housing, and a respective rotor body surrounding a respective shaft, said bodies having parallel end surfaces between the end walls of the rotor housing, wherein each said rotor body includes mutually separated helical lobes that have a crown, a first or leading flank surface on a first side of the crown and a second or trailing flank surface on a second side of the crown, and wherein the second or trailing flanks of said lobes of at least one of the rotor bodies are beveled or chamfered adjacent to an end surface of the rotor body at said outlet port.

2. The helical screw rotor compressor according to claim 1, wherein the rotor body comprises a polymeric material.

3. The helical screw rotor compressor according to claim 2, wherein the rotor body comprises a thermoplastic resin.

4. The helical screw rotor compressor according to claim 2, wherein the rotor body comprises a thermosetting resin.

5. The helical screw rotor compressor according to claim 1, wherein the bevel or chamfer functions to reduce the width of the lobe at said end surface by at most 3 mm.

6. The helical screw rotor compressor according to claim 1, wherein the bevel or chamfer functions to reduce the width of the lobe at said end surface by 0.5 mm at the lowest.

7. The helical screw rotor compressor according to claim 1, wherein the bevel or chamfer is perpendicular to the end surface.

8. The helical screw rotor compressor according to claim 1, wherein the rotor shaft is made of steel.

* * * * *